United States Patent [19]

Becker

[11] Patent Number: 4,929,094

[45] Date of Patent: May 29, 1990

[54] PORTABLE, INSULATED STORAGE CONTAINER

[75] Inventor: Dawn M. Becker, Byron, Calif.

[73] Assignee: Bye, Moms Inc., San Francisco, Calif.

[21] Appl. No.: 369,868

[22] Filed: Jun. 22, 1989

[51] Int. Cl.[5] ..... B65D 33/06; B65D 33/16

[52] U.S. Cl. ..... 383/7; 383/37; 383/99; 383/110; 383/111

[58] Field of Search ..... 383/99, 110, 111, 7, 383/37

[56] References Cited

U.S. PATENT DOCUMENTS

| | | | |
|---|---|---|---|
| 670,360 | 3/1901 | Lawler | 383/7 |
| 1,700,615 | 1/1929 | O'Brien | 383/110 |
| 1,768,989 | 7/1930 | Laacke | 383/110 |
| 2,123,031 | 7/1938 | Weiner | 383/110 |
| 2,857,949 | 10/1958 | Ziff | 383/110 |
| 2,954,891 | 10/1960 | Imber | 383/110 |
| 3,031,121 | 4/1962 | Chase | 383/110 |
| 4,185,673 | 1/1980 | Daniello | 383/110 |
| 4,211,091 | 7/1980 | Campbell | 383/110 |
| 4,537,313 | 8/1985 | Workman | 383/110 |
| 4,679,242 | 7/1987 | Brockhaus | 383/110 |

FOREIGN PATENT DOCUMENTS

| | | | |
|---|---|---|---|
| 559274 | 2/1944 | United Kingdom | 383/7 |

*Primary Examiner*—Stephen P. Garbe

*Attorney, Agent, or Firm*—Thomas R. Lampe

[57] ABSTRACT

A portable, insulated, storage container including a bag and a receptacle positionable in the bag including flap structure which projects outwardly from the remainder of the receptacle and provides means whereby the receptacle may be positioned in the bag or removed therefrom.

10 Claims, 3 Drawing Sheets

PORTABLE, INSULATED STORAGE CONTAINER

TECHNICAL FIELD

This invention relates to a container which may be used for the storage and transport of articles. The container includes an outer bag and a receptacle adapted for insertion into the bag interior. The receptacle is so constructed as to provide end flap structure to be grasped by the user to facilitate both placement of the receptacle into the bag and removal of the receptacle from the bag. The end flap structure may readily be tucked into position between the walls of the receptacle and the bag when the receptacle is disposed in the bag. When, however, the end flap structure does not have an inwardly directed force applied thereto, the construction thereof is such that the end flap structure will be maintained in a generally extended condition facilitating manual grasping thereof.

BACKGROUND ART

Portable, insulated storage containers are known in the art and such containers may be used, for example, for storing bottled or canned beverages and the like. Such containers have also been utilized for a variety of other purposes such as the storage and transport of other types of articles.

A number of the aforesaid prior art containers have included outer bags and receptacles which are selectively positionable in the bag or removable therefrom. Often, the user has a difficult time maintaining a grasp of the receptacle when inserting or removing it. While it is known to affix separate handles to the receptacle, such feature adds cost to the container. Further, it is not unknown for handles to break away from the receptacle, particularly when the receptacle is filled with heavy objects. Another difficulty arises in that handles affixed to receptacles of this nature can distort the receptacle when it is being removed or inserted into position relative to the bag. Obviously, this can make it difficult to carry out these actions.

DISCLOSURE OF THE INVENTION

The present invention, in common with the containers described above, includes a bag and a receptacle adapted for insertion into the interior of the bag. The present container, however, differs from the prior art approaches in that the receptacle is so constructed as to include integral manually graspable end flap structure which extends away from the rest of the receptacle in the absence of outside forces being applied thereto. This greatly facilitates manual grasping of the end flap structure. Since the end flap structure of the present invention is integral with the rest of the receptacle, such structure is quite strong and there is no danger that it will be ripped or torn away during use. On the other hand, the end flap structure is such that it may readily be tucked into position and out of the way when the receptacle has been inserted into the bag.

Other features, advantages, and objects of the present invention will become apparent with reference to the following detailed description and accompanying drawings.

BEST MODE FOR CARRYING OUT THE INVENTION

Figure 1:
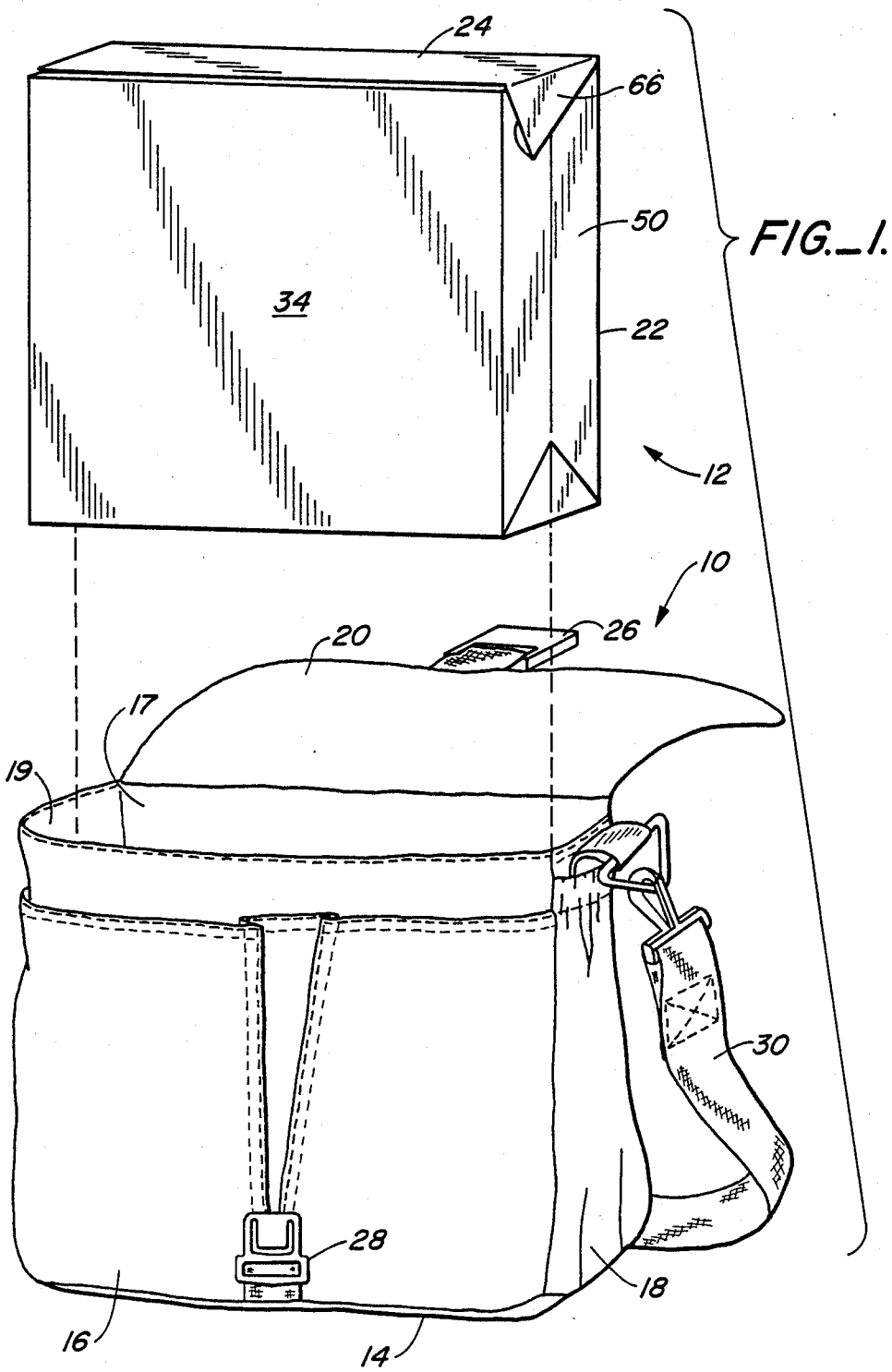
FIG. 1 is an exploded view of a preferred form of container constructed in accordance with the teachings of the present invention and showing the container receptacle removed from the container bag.

Referring now to the drawings, a portable, insulated, storage container constructed in accordance with the teachings of the present invention is illustrated. The container includes a bag 10 and a receptacle 12 adapted for selective positioning within bag 10 as well as removal therefrom.

The bag 10 is preferably constructed of a flexible material such as plastic or cloth and includes a bag bottom wall 14, side walls 16, 17, and end walls 18, 19. A cover 20 is connected to side wall 17 and, as is conventional, is movable between a first position whereat the cover 20 closes the interior of the bag defined by the bottom, side and end walls thereof to a second position whereat the cover does not close the interior. In FIG. 1, the cover is shown in such second position.

Receptacle 12 is adapted for insertion into the bag interior. The receptacle 12 includes a body portion 22 and a closure portion 24 which is integral with the body portion and adapted to selectively open and close the receptacle. When the closed receptacle is positioned in the bag 10, cover 20 may be closed and secured in position by a strap 26 passing through a buckle 28. A carrying strap 30 also may comprise part of the bag 10.

Closure portion 24 includes a first primary flap 32 hingedly connected to a first body portion side wall 34 along a first fold line 36. A second primary flap 38 is hingedly connected along a second fold line 40 to a second body portion side wall 42 in spaced opposition to the first body portion side wall 34.

Manually graspable end flap structures 44, 46 are disposed between the first and second primary flaps 32, 38 and extend from opposed receptacle body portion end walls 48, 50 disposed between side walls 34, 42. The body portion 22 further includes a bottom wall 52.

Figure 2:
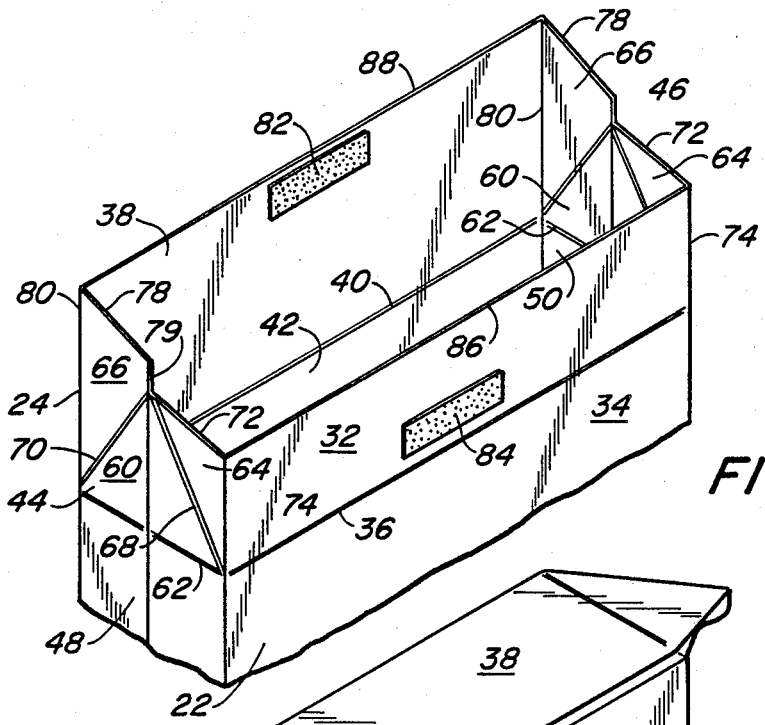
FIG. 2 is an enlarged perspective view illustrating the upper portion of the receptacle with the closure portion thereof in open condition.
Figure 2A:
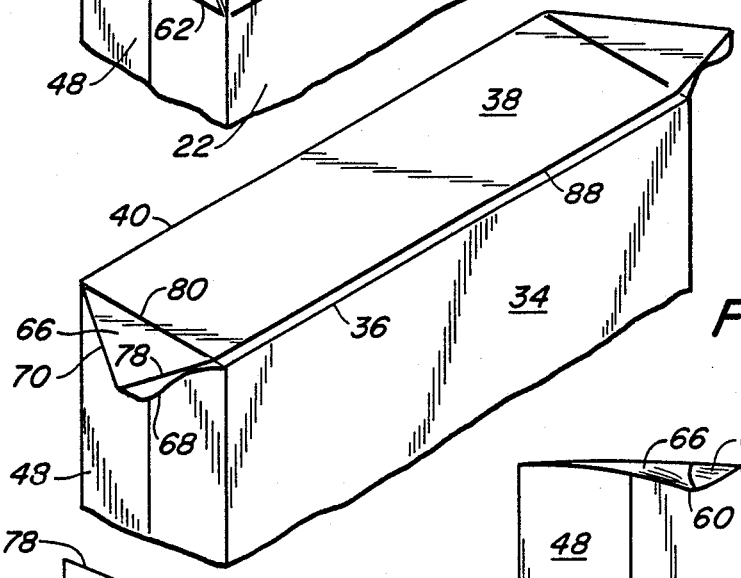
FIG. 2A is a view similar to FIG. 2 but illustrating the receptacle closure portion in closed condition.

End flap structures 44, 46 are, as shown, disposed between the first and second primary flaps 32, 38, and when the receptacle is closed by closure portion 24, the first and second primary flaps are in overlapping relationship as may perhaps best be seen with reference to FIG. 2A. When the primary flaps are in such overlapping relationship, the end flap structures 44, 46 project outwardly from the bottom portion end walls as shown in FIG. 2A.

Each end flap structure comprises a first generally triangular-shaped auxiliary flap 60 hingedly connected along one side thereof to its respective body portion end wall along a first flap fold line 62 extending between first and second fold lines 36, 40. Each end flap structure further comprises second and third generally triangular-shaped auxiliary flaps 64, 66, respectively, along second and third flap fold lines 68, 70, respectively.

Figure 3A:
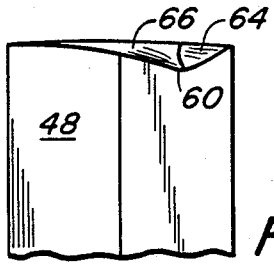
FIG. 3A is a side elevation view of the receptacle portion shown in FIG. 2A with flap structure extended.
Figure 3:
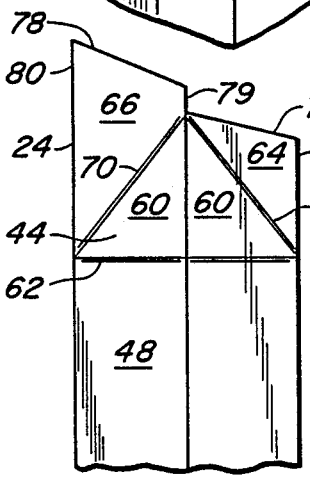
FIG. 3 is a side elevation view of the receptacle portion shown in FIG. 2.
Figure 3B:
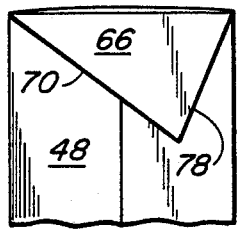
FIG. 3B is a side elevation view similar to FIG. 3A but showing flap structure in unextended condition.

As may perhaps best be seen with reference to FIGS. 2 and 3 second auxiliary flap 64 is defined by the second flap fold line 68, a second auxiliary flap terminal end 72, and a fourth flap fold line 74 disposed between first primary flap 32 and the second auxiliary flap 64.

The third auxiliary flap 66 is defined by the third flap fold line 70, a third auxiliary flap terminal end 78, a fifth flap fold line 80 disposed between second primary flap 38 and the third auxiliary flap, and a line of truncation 79 interconnecting fold line 70 and terminal end 78.

It may be seen that the first primary flap 32 is smaller than the second primary flap 38 and also smaller than the body portion bottom wall 52. The second primary flap 38 generally corresponds in size to the body portion bottom wall 52 and is adapted to substantially overlie the receptacle bottom wall and the first primary flap when the receptacle is closed by the closure portion and the container is upright. Synthetic attachment strips, such as those sold under the trademark Velcro, may be utilized to secure the primary flaps together when the receptacle is closed by the closure portion. These Velcro strips are identified by reference numerals 82, 84.

Again, as may perhaps best be seen with reference to FIGS. 2, 3, first and second primary flaps 32, 38 have, respectively, terminal ends 86, 88. Thus, the second and third auxiliary flap terminal ends which extend between the primary flap terminal ends are disposed at an angle relative to first flap fold line 62.

The receptacle is preferably formed of multi-laminate material including a layer of insulating material, such as plastic foam, sandwiched between spaced outer layers of plastic sheet material. The body portion bottom, side and end walls and the primary and auxiliary flaps are preferably defined by heat seal lines formed in the multi-laminate material.

When the primary flaps are disposed in the closed condition illustrated in FIG. 2A, the end flap structure will fold along the lines defining the auxiliary flaps so that the first auxiliary flap 60 is positioned underneath the rest of the flap structure. Positioned just over first auxiliary flap 60 is second auxiliary flap 64. Third auxiliary flap 66 is then positioned over both the first and second auxiliary flaps. This arrangement results in the flap structure projecting outwardly from the body portion end walls 48, 50 in the absence of an outside force being applied to the flap structure.

Figure 4:
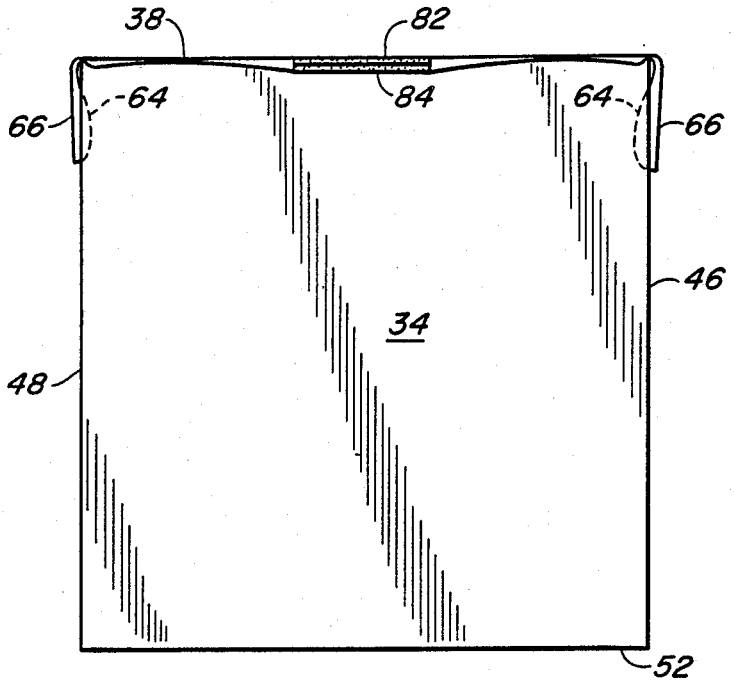
FIG. 4 is a front elevation view of the container receptacle showing the primary flaps of the closure portion closed with the end flap structure in unextended condition such as that assumed when the end flaps are tucked between the container receptacle and the container bag.
Figure 4A:
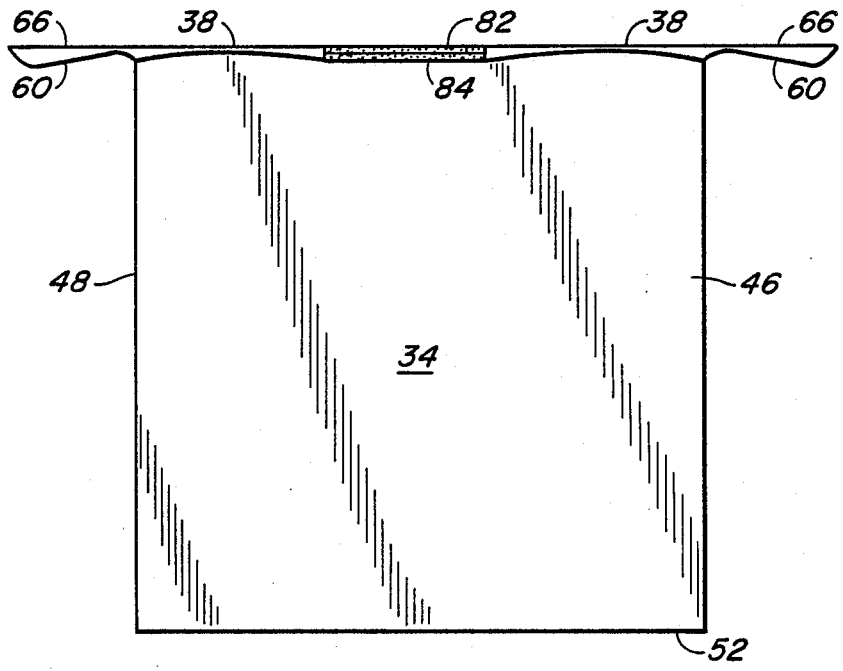
FIG. 4A is a front elevation view of the container receptacle but showing the end flap structure in extended position.

Because the primary flap 38 extends so that its terminal end 88 is generally aligned with first body portion side wall 34 when the closure portion is closed, first and second auxiliary flaps 60, 64 must deform as shown in FIG. 2A and FIG. 4A. Because the material forming flaps 60, 64 has an inherent resilience, flaps 60, 64 will continuously urge auxiliary flap 66 upwardly and outwardly, thus causing the flap structure as a whole to extend outwardly.

The outwardly projecting auxiliary flaps provide a substantial structure for manual grasping by the user when inserting the receptacle 12 in bag 10 or removing the receptacle therefrom. When the receptacle is in position within the bag, the flap structures may be tucked between the receptacle end walls 48, 50 and the bag end walls 18, 19 and held in unextended condition.

What is claimed is:

1. A portable, insulated, storage container comprising, in combination:

a bag having interconnected bag bottom, side, and end walls defining an interior and a cover connected to at least one of said bag walls and moveable between a first position whereat said cover closes said interior and a second position whereat said cover does not close said interior; and a receptacle adapted for insertion into said bag interior, said receptacle having a body portion including bottom, side, and end walls having a configuration generally corresponding to the configuration of said bag interior whereby said receptacle body portion is in engagement with said bag bottom, side, and end walls when said receptacle is disposed in said bag interior, and said receptacle further including a closure portion integral with said body portion to selectively open and close said receptacle, said closure portion including a first primary flap hingedly connected to a first body portion side wall, along a first fold line, a second primary flap hingedly connected along a second fold line to a second body portion side wall in spaced opposition to said first body portion side wall, and manually graspable end flap structure comprising a plurality of interconnected auxiliary flaps disposed between said first and second primary flaps and extending from opposed receptacle body portion end walls, said first and second primary flaps being in at least partially overlapping relationship when said receptacle is closed by said closure portion, and said end flap structure projecting outwardly beyond said body portion end walls when said primary flaps are in said at least partially overlapping relationship.

2. The container according to claim 1 wherein each said end flap structure comprises a first generally triangular-shaped auxiliary flap hingedly connected along one side thereof to one of said body portion end walls along a first flap fold line extending between said first and second fold lines and second and third generally triangular-shaped auxiliary flaps hingedly connected to said first auxiliary flap along second and third flap fold lines, said second and third flap fold lines defining second and third sides of said first auxiliary flap and said second and third auxiliary flaps being disposed, respectively, along said second and third sides.

3. The container according to claim 2 wherein said second auxiliary flap is defined by said second flap fold line, a second auxiliary flap terminal end, and a fourth flap fold line disposed between s id first primary flap and said second auxiliary flap.

4. The container according to claim 3 wherein said third auxiliary flap is defined by said third flap fold line, a third auxiliary flap terminal end, a fifth flap fold line disposed between said second primary flap and said third auxiliary flap, and a line of truncation interconnecting said third flap fold line and third auxiliary flap terminal end.

5. The container according to claim 4 wherein said first primary flap is smaller than said second primary flap and said body portion bottom wall, said second primary flap generally corresponding in size to said body portion bottom wall and adapted to substantially overlie said receptacle bottom wall and said first primary flap when said receptacle is closed by said closure portion and said container is upright.

6. The container according to claim 5 wherein both said second auxiliary flap terminal end and said third auxiliary flap terminal end are disposed at an angle relative to said first flap fold line.

7. The container according to claim 6 wherein said first and second primary flaps have primary flap terminal ends and wherein said second auxiliary flap terminal end extends from said first primary flap terminal end and wherein said third auxiliary flap terminal end extends from said second primary flap terminal end.

8. The container according to claim 5 additionally comprising securing means for securing said primary flaps together when said receptacle is closed by said closure portion.

9. The container according to claim 1 wherein said receptacle is formed of multi-laminate material including a layer of insulating material sandwiched between spaced outer layers of plastic sheet material, said body portion bottom, side and end walls and said primary and auxiliary flaps being defined by heat seal lines formed in said multi-laminate material.

10. The container according to claim 9 wherein said primary flaps and said auxiliary flaps cooperate to maintain said end flap structure in a generally extended condition when said primary flaps are in at least partially overlapping relationship.

* * * * *